United States Patent [19]

Scriven

[11] Patent Number: 5,022,635

[45] Date of Patent: Jun. 11, 1991

[54] REMOVEABLE COVER FOR A HOT METAL TRANSFER CAR

[75] Inventor: Ricky R. Scriven, Allen Park, Mich.

[73] Assignee: Tri-Star Manufacturing & Service, Inc., Oakmont, Pa.

[21] Appl. No.: 459,062

[22] Filed: Dec. 29, 1989

[51] Int. Cl.[5] ..... C21B 3/10

[52] U.S. Cl. ..... 266/165; 266/271

[58] Field of Search ..... 266/165, 276, 248, 271; 432/250; 105/264, 275

[56] References Cited

U.S. PATENT DOCUMENTS

| | | | |
|---|---|---|---|
| 1,974,532 | 9/1934 | DeFries | 266/165 |
| 4,260,141 | 4/1981 | Nagati | 266/287 |
| 4,298,191 | 11/1981 | Atkinson et al. | 266/165 |
| 4,381,855 | 5/1983 | Ryan | 266/248 |

*Primary Examiner*—S. Kastler

*Attorney, Agent, or Firm*—Parmelee, Miller, Welsh & Kratz

[57] ABSTRACT

A hot metal transfer car has a pouring mouth and integral apparatus for removably covering the pouring mouth.

A track has a first section which is supported by the transfer car at one end and extends upwardly toward its second end. A second section of the track extends downwardly away from the second end toward the pouring mouth. A carriage driven by means of a motor and a chain drive moves on the track. A pouring mouth cover having a handling arm slideably connected with the carriage is moved over the track by the carriage.

6 Claims, 4 Drawing Sheets

REMOVEABLE COVER FOR A HOT METAL TRANSFER CAR

BACKGROUND OF THE INVENTION

This invention relates to a removeable cover for a hot metal transfer car and, more particularly, to a cover which is integral with the car.

Hot metal transfer cars are employed to transfer large amounts of liquid metal between processing steps. For example, liquid metal must be transferred between the melting, refining and casting operations in primary steel making operations. Aluminum and other metals and materials are similarly transferred as hot liquids between processing steps. Reference is made to U.S. Pat. Nos. 4,260,141 and 4,381,855 which generally show a torpedo or Pugh-type car which is frequently employed because of its large capacity. Such a car may have a capacity of 200 tons or more. Kling-type cars may be employed where smaller capacities are needed. As U.S. Pat. No. 4,381,855 discloses, removeable covers are employed to cover the upwardly facing pouring mouths of the cars to conserve heat in the car while the (full or empty) car is being transferred or held between processing steps. According to the disclosure of U.S. Pat. No. 4,381,855, tests have shown that covers may conserve up to about 300° F.

Various assemblies which previously have been devised to conserve heat are unsatisfactory for a variety of reasons. Manually tied down blankets involve handling problems and personal danger to laborers. Cranes generally require too much head space and area in which to operate, which is a particular problem in this application because draft hoods are positioned very close to the pouring mouth for limiting fume releases to the environment. Thus, there may be little clearance around the pouring mouth in which covering apparatus may operate. Tracked cranes mounted on the cars are structurally complex, expensive and difficult to maintain.

SUMMARY OF THE INVENTION

Apparatus embodying the present invention is simpler, less expensive and easier to maintain than are devices now employed to cover transfer cars. Apparatus embodying the present invention includes a track integral with the transfer car. The track has a first track section adapted to be supported by the transfer car and extending upwardly toward the pouring mouth of the car and has a second track section extending downwardly away from the first track section. A carriage is moveably supported on the track and is operatively connected with a drive means for moving the carriage on the track. A pouring mouth cover is operatively connected with the carriage for moving the cover relative to the pouring mouth.

Other details, objects and advantages of the invention will become apparent as the following description of a presently preferred embodiment thereof proceeds.

DESCRIPTION OF THE INVENTION

The accompanying drawings illustrate a preferred embodiment of the invention in which:

FIG. 1 generally depicts a hot metal transfer car having a pouring mouth and apparatus embodying the present invention for removably covering the pouring mouth;

FIG. 2 is an enlarged front view which generally depicts the apparatus embodying the present invention (as shown in FIG. 1) covering the pouring mouth;

FIG. 3 generally depicts the apparatus embodying the present invention shown in FIG. 1 but partially uncovering the pouring mouth;

FIG. 4 generally depicts the apparatus embodying the present invention shown in FIG. 1 but in a fully retracted position from the pouring mouth;

FIG. 5 generally depicts an end view of the carriage shown in FIGS. 1–3, generally taken along line 5—5 of FIG. 3—3;

FIG. 6 generally depicts a front view of the pouring mouth cover shown in FIG. 1;

FIG. 7 generally depicts a plan view of the pouring mouth cover of FIG. 6 generally taken along line 7—7;

FIG. 8 generally depicts another apparatus embodying the present invention for removably covering the pouring mouth;

FIG. 9 generally depicts a top view of the track shown in FIG. 8 taken along line 9—9;

FIG. 10 generally depicts an end section view of the carriage of FIG. 8 taken along line 10—10; and FIG. 11 generally depicts an end view of the carriage of FIG. 8 taken along line 11—11.

DESCRIPTION OF THE PREFERRED EMBODIMENTS

Figure 1:
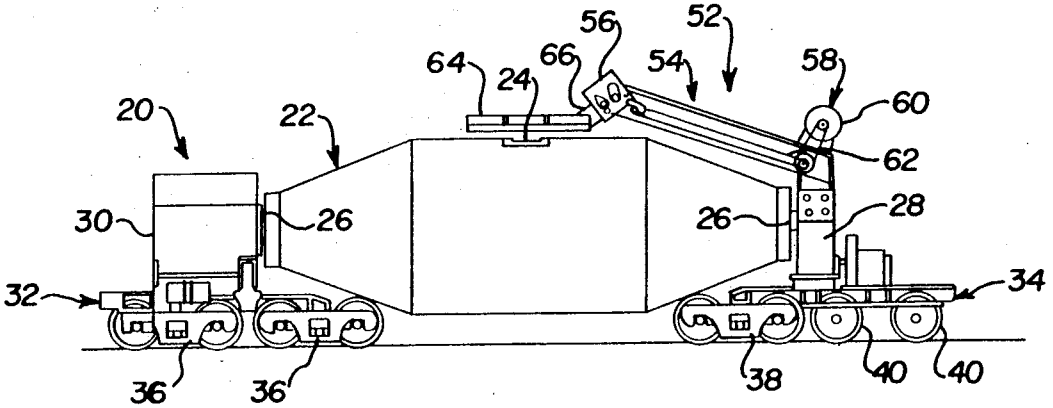

FIG. 1 generally illustrates a Pugh (or torpedo) type hot metal transfer car 20. Briefly, the transfer car 20 has a rotatable ladle or vessel 22 with a pouring mouth 24. The vessel 22 rotates on trunnions 26, which are rotatably supported by bearings (not shown) disposed within the housings 28, 30. The bearings are carried on platforms 32, 34 mounted on pivotable wheeled trucks 36, 38 and/or on wheel-and-axle assemblies 40 which need not pivot.

Apparatus 52 for removably covering the pouring mouth 24 is integrally mounted either on the one housing 28 as shown or on the other housing 30. The apparatus 52 generally includes a track 54 which extends from the mounting arrangement toward the pouring mouth 24; a carriage 56 moveably supported on the track 54; a means 58 for moving the carriage 56 over the track 54, including a motor 60 operatively connected with the carriage 56 by a chain drive assembly 62; and a pouring mouth cover 64 having a handling arm 66 operatively connected with the carriage 56. FIG. 1 shows the pouring mouth cover 64 over the pouring mouth 24 of the transfer car 20. The vessel 22 may be full or empty when the pouring mouth cover is in the shown position.

Figure 2:
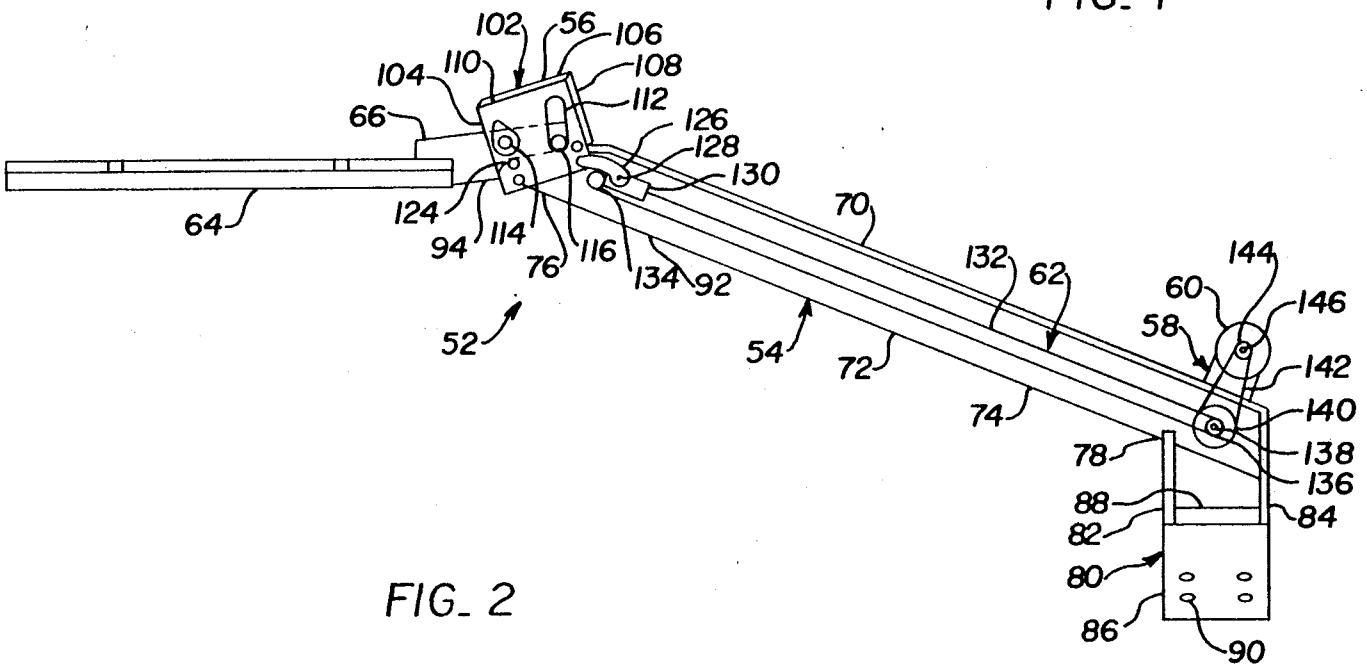

FIG. 2 is an enlarged view of the covering apparatus 52 as it is shown in FIG. 1. The track 54 is generally comprised of a flat plate 70 welded onto a generally rectangular structure 72 comprising half inch plates with a hollow center for reducing the weight of the structure. The track 54 has a first track section 74 and a second track section 76. The first track section 74 has a first end 78 adapted to be supported by the housing 28 of the transfer car 20. Thus, the first end 78 is supported by a support assembly 80 comprising a pair of support plates 82, 84 which are reinforced by a pair of vertical plates 86 and a horizontal plate 88. The first end 78 may be welded or otherwise suitably attached to the support plates 82, 84. Counterweights and/or spring assemblies (not shown) may be positioned outboard of the rear vertical plate 84 to stabilize a track where a relatively light track is employed to remove a heavy cover. The support assembly 80 may be mounted to the housing 28 with bolts (not shown) extending through bolt holes 90 or other suitable fastening means. If the housings 28, 30 and the platforms 32, 34 are designed to pivot relative to the trunnion 26 when, e.g., the hot metal transfer car 20 negotiates a curved track section, then the covering apparatus 52 shown in FIG. 1 would pivot with the housing 28 on which it is mounted and the pouring mouth cover 64 would slide over the pouring mouth 24. Thus, the support assembly would preferably be mounted on bearing chocks (not shown) or other structure which supports the trunnion 26.

The first track section 74 extends upwardly from its first end 78 toward a second end 92. The second track section 76 then extends downwardly away from the second end 92 of the first track section 74 toward the pouring mouth 24.

Figure 3:
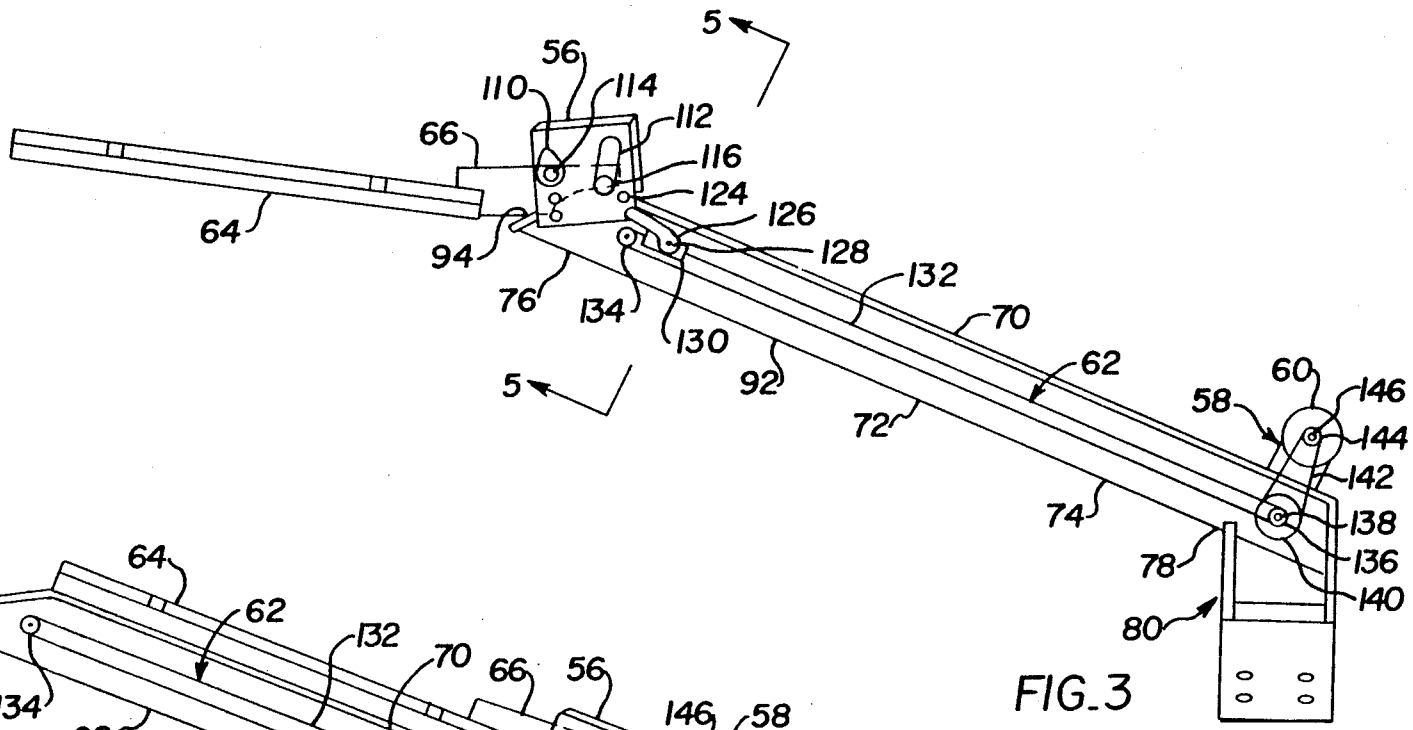
Figure 4:
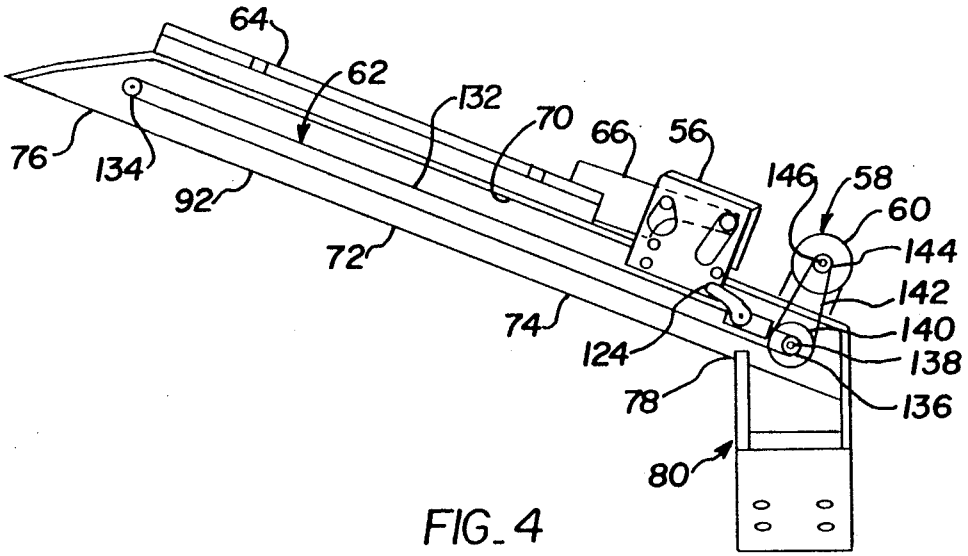

FIGS. 3 and 4 are similar to FIG. 2 except that FIG. 3 depicts the pouring mouth cover 64 in a position partially covering the pouring mouth 24 (not shown in FIGS. 2–4) when, e.g., the carriage has just begun to move. As FIGS. 2 and 3 generally show, the bottom surface 94 of the handling arm 66 is supported on the flat plate 70 when the carriage 56 is engaged with the second track section 76. FIG. 4 depicts the pouring mouth cover 64 in a fully retracted position from the pouring mouth 24. As FIG. 4 generally shows, the pouring mouth cover 64 itself is supported on the flat plate 70 when the carriage 56 is engaged with the first track section 74. The pouring mouth cover 64 and/or its handling arm 66 may be provided with rollers (not shown) which roll over the flat plate 70 instead of sliding over the flat plate 70 as does the cover 64 shown, but rollers are not necessary in most cases.

The carriage 56 generally comprises a frame 102 having vertical plates 104 spaced by a top plate 106 and a back plate 108. Each of the vertical plates 104 has two slots 110, 112 for operatively engaging fingers 114, 116 extending from the handling arm 66 extending from the pouring mouth cover 64. These two slots permit the fingers 114, 116 to move vertically relative to the carriage 56 as the pouring mouth cover 64 moves over the first and second track sections 74, 76 respectively.

Figure 5:
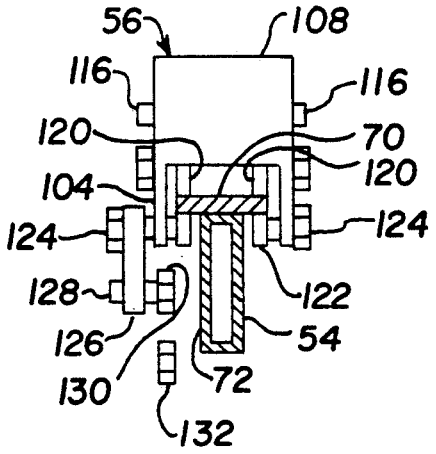

As is best seen in FIG. 5, the carriage 56 is guided as well as supported by the track 54. Thus, the carriage 56 has spaced apart pairs of rollers 120 which engage the flange portions 122 of the flat plate 70. The rollers 120 are fastened to the vertical walls 104 of the carriage 56 by nuts 124 which threadedly engage roller shafts extending through holes in the vertical walls 104.

The carriage 56 is operatively connected with the motor 60 and its chain drive 62 by any suitable means. FIGS. 2–5 generally show a connecting link 126 pivotally connected to an extended shaft of one roller 120 and to a pivot pin 128 extending from a bracket 130 connected with the links of a first chain 132. The first chain 132 is driven around a front sprocket 134 and a rear sprocket 136 which is mounted on a common shaft 138 with a sprocket 140. A second chain 142 is driven around the sprocket 140 and another sprocket 144 mounted on the motor shaft 146 extending from the motor 60. The motor 60 may be located on the track 54 as is shown in any other suitable location such as an horizontal plate 88. Other suitable drives and drive systems may be alternately employed so long as they are reasonably rugged and can operate in hostile environments. Air motors operated on plant air may be employed in many plants in place of electric motors.

Figure 6:
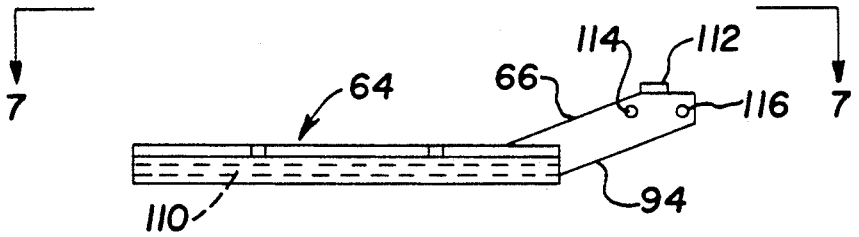
Figure 7:
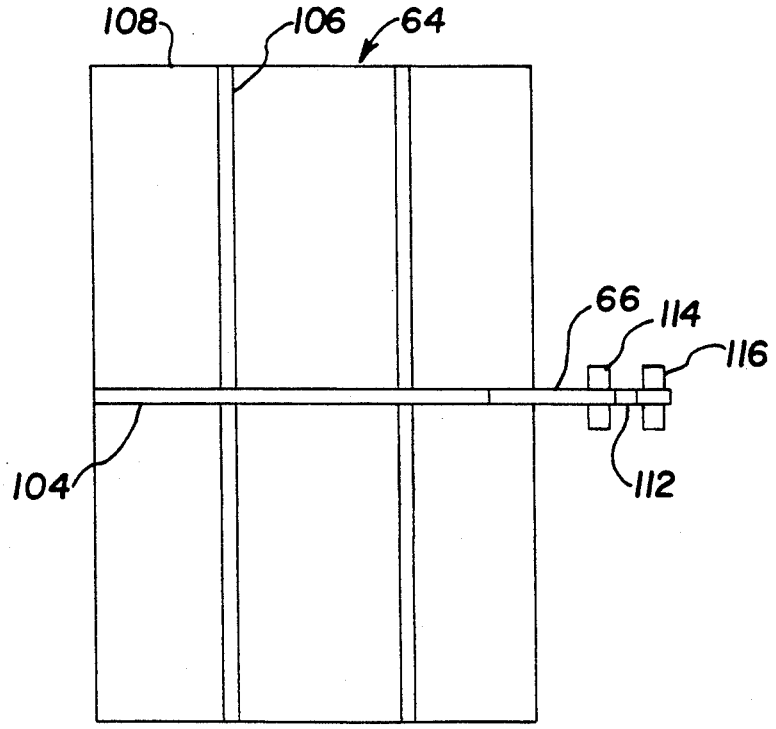

FIGS. 6 and 7 best show the pouring mouth cover 64 and its handling arm 66. The pouring mouth cover 64 generally has a frame 102 comprising a central length of heavy walled tubing 104 with transverse lengths 106 welded thereto. The frame 102 supports a downwardly open box 108 made of steel sheet or other suitable material for receiving ceramic wool sheets comprising up to sixteen layers or more layers 110 which are fastened thereto. As is shown in FIG. 7, the central length 104 is welded to the handling arm 66. Also, the handling arm 66 may have a small stop plate 112 disposed between its fingers 114, 116 for engaging the carriage top plate 106 to prevent the fingers 114, 116 from being bent against the slot walls when the center of gravity of the pouring mouth cover suddenly transfers from over the first track section 74 to over the second track section 76.

The handling arm 66 extending from the pouring mouth cover 64 is operatively connected with the carriage 56 at all times while the transfer car is in service. When it is desired to charge or discharge the transfer car 20, the drive means 58 pulls the carriage 56 up the second track section 76 and onto the first track section 74. The bottom surface 94 of the handling arm 66 first slides upwardly on the flat plate 70 and the pouring mouth cover 64 begins to pivot on the bottom surface 94 as the carriage 56 moves from the second track section 76 to the first track section 74. When the carriage 56 has been retracted to the point where it is entirely on the first track section 74, the cover 64 is generally aligned with the flat plate 70. As the carriage 56 is retracted to the position shown in FIG. 4, the pouring mouth cover 64 slides over the flat plate 70 and is thereby supported until the cover 64 is to be advanced to the original position over the pouring mouth.

Figure 9:
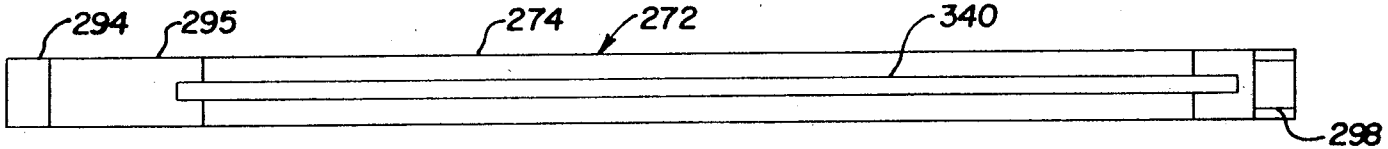
Figure 8:
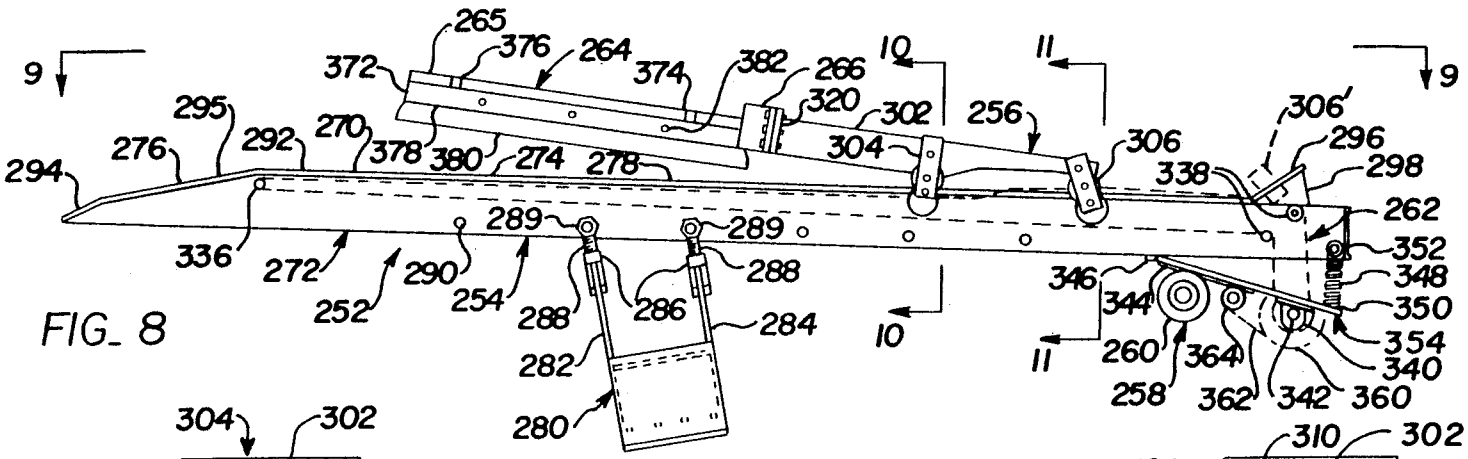

FIGS. 8–11 depict an embodiment of the present invention which is particularly useful in areas where there is little clearance over the pouring mouth of a hot metal transfer car. As is best seen in FIG. 8, the improved covering apparatus 252 generally has a track 254 extending from a mounting arrangement toward the pouring mouth; a carriage 256 moveably supported on the track 254; a means 258 for moving the carriage 256 over the track 254, including a motor 260 operatively connected with the carriage 256 by a chain drive assembly 262; and a pouring mouth cover 264 having a handling arm 266 operatively connected with the carriage 256.

The track 254 is generally comprised of a flat plate 270 welded onto a generally rectangular hollow structure 272 formed by thick steel plates. The track 254 generally has a first track section 274 and a second track section 276. The first track section 274 has a first end 278 which is adapted to be adjustably supported by a support assembly 280 which in turn is supported on the housing 28 (shown in FIG. 1) or on bearing chocks (not shown). The support assembly 280 includes a pair of support plates 282, 284 to which are welded nuts 286 which receive the threaded stems of eye bolts 288.

The eyebolts 288 are fastened by bolts 289 extending through certain holes 290 to the rectangular structure 272. In the apparatus shown in FIG. 8, the track 272 is fastened by four bolts 289, there being two bolts 289 disposed on either side of the rectangular structure.

The first track section 274 extends upwardly from its first end 278 toward a second end 292. The second track section 276 then extends downwardly away from the second end 292 of the first track section 274 toward the pouring mouth 24. As is shown in FIG. 8, the second track section 276 has a distal end 294 which extends downwardly from the first track section 274 at a lesser angle relative to the horizontal than the angle defined by the main portion 295 of the second track section 276. This distal end 294 is normally only about four to eight inches long and is designed to tilt the cantilevered far end 265 of the pouring mouth cover 264 as high as is permitted by the draft hood (not shown) disposed above the hot metal transfer car. Depending upon the size of the pouring mouth cover 264 and the angle defined by the distal end 294 of the second track section 276, the far end 295 of the pouring mouth cover 264 may be designed to rise about six inches for each quarter inch advance of the carriage 256 over the distal end 294. Thus, there is little, if any, sliding contact between the pouring mouth 24 and its cover 264.

As is shown in FIG. 8, and as will be described later, the flat plate 270 may extend upwardly at the distal portion 296 of the first end section 278. The flat plate 270 is supported in this area by a vertical plate 298 welded to the rectangular structure 272.

The carriage 256 generally comprises an elongated member 302 pivotally supporting first and second collars 304, 306 respectively on shafts 308, 310. The collars 304, 306 support spaced pairs of rollers 312, 314 which engage the flange portions 320 of the flat plate 270. The roller 312, 314 are fastened to the collars 304, 306 respectively by nuts 316, 318 respectively which threadedly engage roller shafts extending through holes in the collars 304, 306. In a similar embodiment (not shown) the first collar 304 may only employ rollers 312 above the flange portions 320 and the second collar 306 may only employ rollers 314 below the flange portions 320.

Figure 11:
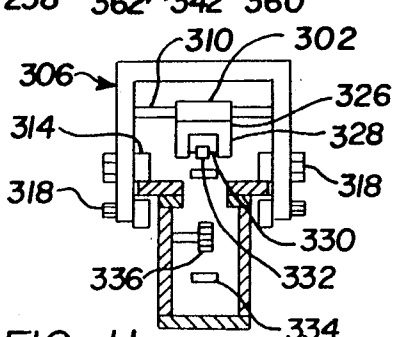
Figure 10:
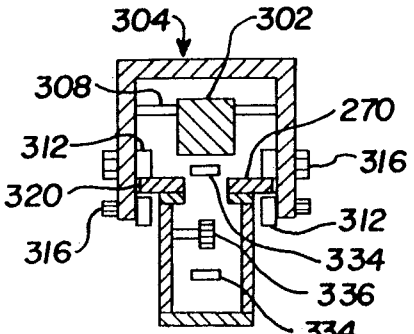

The carriage 256 is operatively connected with a drive means, such as the air motor 260 depicted by an inlet connection, and its chain drive 262 by any suitable means. As is best seen in FIG. 11, a bracket 326 welded or fastened to the underside of the elongated carriage member 302 has downwardly extending arms 328 which rotatably support a linking pin 330 extending through a link 332 of a first chain 334. The chain 334 is driven around a front idler sprocket 336, intermediate idler sprockets 338 and a rear sprocket 340. The upper portion of the first chain 334 including link 332 is shown for purposes of clarity as travelling through an elongated slot 340 extending through the flat plate 270 and the supporting rectangular structure 272. The upper portion of the chain 334 may alternatively travel through two spaced apart holes near the ends 278, 293 of the first track section 274 and also over this section 274. The lower portion of the chain 334 generally travels within the hollow center of the rectangular structure 272 and out through two holes (not shown) to the rear sprocket 340.

The rear sprocket 340 is on a shaft 342 rotatably mounted on a hinged underplate 344. The underplate 344 is pivotally attached to the rectangular structure 272 by a hinge 346 and urged away from the rectangular structure 272 by a compressed spring 348 maintained in place by an eyebolt 350. The eyebolt 350 is pivotally connected to the structure 272 by a fastening bolt 352 and to the underplate 344 by an internally threaded nut 354. The sprocket shaft 342 also supports a larger sprocket 360 which is driven by a second chain 362 operatively connected with a drive sprocket 364 mounted on the output shaft 366 of the air motor 260. As is most clearly seen in FIG. 8, the relatively short second chain 362 is driven between two sprockets 360, 364 which are mounted on the underplate 344, However, the longer first chain 334, which includes the link 332 operatively connected to the carriage 256, is driven by the rear sprocket 340 mounted on the underplate 344 around other sprockets 336, 338 mounted on the generally rectangular structure 272. Thus, any vertical movement of the connecting link 332 of the first chain 334 is operatively opposed by the compressed spring 348.

FIG. 8 generally shows a pouring mouth cover 264 having a handling arm 266 which is fastened to the carriage 256 by connecting bolts 370. The pouring mouth cover 264 generally has a frame 372 comprising a central tubing length 374 welded to the connecting arm 266 and transverse lengths 376 for supporting a downwardly open box 378 made of steel sheet for holding ceramic wool sheets 380. The ceramic wool sheets 380 are fastened in the box 378 with steel rods 382 and generally extend below the box 378 as shown.

The ceramic wool sheets 380 are supported above the track 254 when the carriage 256 is moving and on the track 254 when the carriage 256 is retracted from the pouring mouth 24 of the hot metal transfer car 20. In the fully retracted position, the rollers 314 mounted on the second collar 306 are guided upwardly on the flange portion 320 at the distal portion of the first track section 274 (as is indicated by phantom collar 306,) which causes the pouring mouth cover to descend until it contacts the track 254. This generally reduces the total forces needed to move the pouring mouth cover 264 and limits the wear on the ceramic wool sheets 380 because there is little, if any, substantial sliding friction.

While certain present preferred embodiments of the present invention has been shown and described, it is to be distinctly understood that the invention is not limited thereto but may be otherwise variously embodied with the scope of the following claims.

What is claimed is:

1. Apparatus for removably covering the pouring mouth of a hot metal transfer car to conserve heat in the transfer car, comprising:

a track having a first track section, the first track section having a first end and a second end, the first end adapted to be supported by a hot metal transfer car, the hot metal transfer car having a pouring mouth, the first track section extending upwardly from its first end towards its second end, and having a second track section extending downwardly away from the second end of the first track section toward the pouring mouth;

a carriage moveably supported on the track;

drive means operatively engaged with the carriage for moving the carriage on the track; and a pouring mouth cover having a handling arm slidably connected with the carriage.

2. The apparatus of claim 1, wherein the handling arm is adapted to slide on the second track section.

3. The apparatus of claim 2, wherein the cover is adapted to slide on the first track section.

4. Apparatus for removably covering the pouring mouth of a hot metal transfer car to conserve heat in the transfer car, comprising:

a track having a first track section, the first track section having a first end and a second end, the first end adapted to be supported by a hot metal transfer car, the hot metal transfer car having a pouring mouth, the first track section extending upwardly from its first end towards its second end, and having a second track section extending downwardly away from the second end of the first track section toward the pouring mouth;

a carriage moveably supported on the track;

drive means operatively engaged with the carriage for moving the carriage on the track; and a pouring mouth cover fixedly fastened to the carriage, the pouring mouth cover being spaced above the track when it is moving over the track and then being in contact with the track when the cover is fully retracted from the position where it covers the pouring mouth of the transfer car.

5. The apparatus of claim 1, wherein the track comprises the flanges which guide the carriage and the first end of the track section comprises a distal portion where the track flange upwardly extends away from the second track section.

6. The apparatus of claim 5, wherein the pouring mouth cover is adapted to contact the first track section when the carriage is guided by the distal portion of the track section.

* * * * *